US012583031B2

(12) United States Patent
Golightly et al.

(10) Patent No.: US 12,583,031 B2
(45) Date of Patent: Mar. 24, 2026

(54) METHOD FOR DENSIFICATION OF POWDERED MATERIAL USING THERMAL CYCLING AND MAGNETIC CYCLING

(71) Applicant: Temper IP, LLC, Cedar Springs, MI (US)

(72) Inventors: Jason Golightly, Twin Lake, MI (US); Luke A. Martin, Wyoming, MI (US); William C. Dykstra, Rockford, MI (US)

(73) Assignee: Temper IP, LLC, Cedar Springs, MI (US)

( * ) Notice: Subject to any disclaimer, the term of this patent is extended or adjusted under 35 U.S.C. 154(b) by 773 days.

(21) Appl. No.: 17/760,137

(22) PCT Filed: Feb. 5, 2021

(86) PCT No.: PCT/US2021/070128
§ 371 (c)(1),
(2) Date: Aug. 4, 2022

(87) PCT Pub. No.: WO2021/159150
PCT Pub. Date: Aug. 12, 2021

(65) Prior Publication Data

US 2023/0084714 A1 Mar. 16, 2023

Related U.S. Application Data

(60) Provisional application No. 62/971,305, filed on Feb. 7, 2020.

(51) Int. Cl.
*B22F 3/02* (2006.01)
*B22F 3/24* (2006.01)
(Continued)

(52) U.S. Cl.
CPC ..... *B22F 3/02* (2013.01); *B22F 3/24* (2013.01); *C22C 1/0458* (2013.01);
(Continued)

(58) Field of Classification Search
CPC ..... B22F 3/02; B22F 3/24; B22F 2003/248; B22F 2201/20; B22F 2202/05;
(Continued)

(56) References Cited

U.S. PATENT DOCUMENTS 3,351,501 A 11/1967 Aspden
3,390,986 A 7/1968 Stenerson
(Continued)

FOREIGN PATENT DOCUMENTS

EP 0025040 B1 2/1983
EP 2363619 A2 9/2011
WO 2019246257 A1 12/2019

OTHER PUBLICATIONS

Goh, "The Development of Novel Multifunctional Ti—Ta—Nb—Zr Quaternary Alloy with an e/a of 4.24 via Powder Metallurgy for Low Young's Modulus" Aug. 2014, pp. 1-232 (Year: 2014).*
(Continued)

*Primary Examiner* — Rebecca Janssen
(74) *Attorney, Agent, or Firm* — HONIGMAN LLP

(57) ABSTRACT

A method for densifying a material includes arranging the material in a cavity of a mold and applying pressure to the material in the mold. While applying pressure to the material in the mold, a magnetic field is applied to the material in the mold to cause the material to transform between a first allotrope phase and a second allotrope phase. Applying the magnetic field to the material includes magnetic cycling, which includes one or more iterations of adjusting the magnetic field to a first strength, and then adjusting the magnetic field to a second strength. The method includes
(Continued)

determining a density of the material during the magnetic cycling and, responsive to determination that the determined density reaches a threshold density, stopping the magnetic cycling.

32 Claims, 14 Drawing Sheets

(51) Int. Cl.
*C22C 1/04* (2023.01)
*C22C 14/00* (2006.01)

(52) U.S. Cl.
CPC ..... *B22F 2003/248* (2013.01); *B22F 2201/20* (2013.01); *B22F 2202/05* (2013.01); *B22F 2301/205* (2013.01); *C22C 14/00* (2013.01)

(58) Field of Classification Search
CPC ..... B22F 2301/205; B22F 3/003; B22F 2999/00; B22F 3/14; C22C 1/0458; C22C 14/00; C22C 2200/00
See application file for complete search history.

(56) References Cited

U.S. PATENT DOCUMENTS

| | | | |
|---|---|---|---|
| 3,984,267 | A | 10/1976 | Craford et al. |
| 4,594,219 | A | 6/1986 | Hostatter et al. |
| 4,744,943 | A | 5/1988 | Timm |
| 4,871,621 | A | 10/1989 | Bagley et al. |
| 5,622,745 | A | 4/1997 | Sloan et al. |
| 5,730,914 | A | 3/1998 | Ruppman, Sr. |
| 6,224,816 | B1 | 5/2001 | Hull et al. |
| 6,986,381 | B2 | 1/2006 | Ray et al. |
| 7,905,128 | B2 | 3/2011 | Matsen et al. |
| RE42,329 | E | 5/2011 | Fuerstenau et al. |
| 8,383,998 | B1 | 2/2013 | Matsen et al. |
| 9,457,404 | B2 | 10/2016 | Matsen et al. |
| 9,930,729 | B2 | 3/2018 | Matsen et al. |
| 10,179,940 | B2 | 1/2019 | Kirkwood et al. |
| 2002/0056291 | A1 | 5/2002 | Schultz et al. |
| 2002/0106250 | A1 | 8/2002 | Murakawa et al. |
| 2002/0175006 | A1 | 11/2002 | Findley et al. |
| 2005/0012231 | A1 | 1/2005 | Olsson et al. |
| 2008/0237403 | A1 | 10/2008 | Kelly et al. |
| 2011/0070119 | A1 | 3/2011 | Belhadjhamida et al. |
| 2012/0288583 | A1 | 11/2012 | Segura Moreno et al. |
| 2013/0181061 | A1 | 7/2013 | Carpenter et al. |
| 2013/0330139 | A1 | 12/2013 | De Reynal |
| 2014/0314977 | A1 | 10/2014 | Weinhold |
| 2015/0321250 | A1 | 11/2015 | Xu |
| 2016/0305262 | A1 | 10/2016 | Durocher et al. |
| 2017/0095861 | A1 | 4/2017 | Dykstra et al. |
| 2018/0229463 | A1 | 8/2018 | Hull et al. |
| 2018/0297122 | A1 | 10/2018 | Hadidi et al. |
| 2020/0055115 | A1 | 2/2020 | Caudill |
| 2021/0146437 | A1 | 5/2021 | Danis et al. |
| 2021/0214826 | A1* | 7/2021 | Park ..... C21D 1/04 |

OTHER PUBLICATIONS

Ye et al. Enhanced densification of Ti—6Al—4V powders by transformation-mismatch plasticity, Acta Materialia 58 (2010) 3851-3859, Apr. 18, 2010 (Year: 2010).*

Levin et al. Transformations in the Gd5 Si1.95Ge2.5 alloy induced by the temperature and magnetic-field cycling through the first-order magnetic-martensitic phase transition, Physical Review B 63 064426, published Jan. 23, 2001 (Year: 2001).*

Koch, Experimental evidence for magnetic or electric field effects on phase transformations, Materials Science and Engineering: A, vol. 287, Issue 2, Aug. 15, 2000, pp. 213-218 (Year: 2000).*

Schuh et al., Enhanced densification of metal powders by transformation-mismatch plasticity, Acta Materialia, vol. 48, Issue 8, May 11, 2000, pp. 1639-1653. (Year: 2000).*

International Search Report and Written Opinion dated Apr. 15, 2021 for corresponding PCT Application No. PCT/US2021/070128, filed Feb. 5, 2021.

Goh, "The Decelopment of Novel Multifunctional Ti—Ta—Nb—Zr Quaternary Alloy with an e/a of 4.24 via Powder Metallurgy for Low Young's Modulus" Aug. 2014, pp. 1-232, p. 176, para 2-para 3, p. 151, para 4, p. 110, para 1, p. 47, para 2, p. 55, para 1, p. 57, para 1-para 2, p. 58, para 1-para 2, p. 51, para 1, p. 34, para 1, p. 179, para 2.

* cited by examiner

600

METHOD FOR DENSIFICATION OF POWDERED MATERIAL USING THERMAL CYCLING AND MAGNETIC CYCLING

CROSS REFERENCE TO RELATED APPLICATIONS

The present application is a 371 national stage patent application of PCT/US2021/070128, filed Feb. 5, 2021, which claims the filing benefits of U.S. provisional application Ser. No. 62/971,305, filed Feb. 7, 2020, which is hereby incorporated herein by reference in its entirety.

FIELD OF THE INVENTION

The present invention relates to a method for densifying allotropic material.

BACKGROUND OF THE INVENTION

Titanium has remained an exotic metal prized for its superior strength-to-weight ratio, resilience at high temperatures, superior fatigue life, corrosion resistance, and compatibility with fibers in polymeric composites. However, high processing costs associated with the production of titanium components have kept it beyond the reach of mass production.

SUMMARY OF THE INVENTION

The present invention provides a method for densifying an allotropically transformable material, such as any powdered material that exhibits allotropic transformation, including ceramics such as silicon nitride, and including titanium and titanium alloys, into a near-net-shape component by adjusting the temperature of the material or by using thermal or magnetic cycling to cause the material to transform between a first allotrope phase and a second allotrope phase.

The method includes arranging the material in the cavity of a mold, applying pressure to the material in the mold, and applying a magnetic field to the material in the mold to cause the material to transform between a first allotrope phase and a second allotrope phase. The temperature of the material may be maintained between a determined nominal allotropic phase transformation temperature and a determined shifted allotropic phase transformation temperature, in which implementation, the strength of the magnetic field may be adjusted in a magnetic cycle to cause the material to transform between the first allotrope phase and the second allotrope phase. The method also optionally includes determining that the density of the material satisfies a density threshold. Optionally, after determining that the density of the material satisfies the density threshold, further adjusting the temperature of the material, causing the material to undergo annealing.

The present invention also provides a method for densifying a material, including arranging the material in the cavity of a mold, applying pressure to the material in the mold, setting the temperature (such as by applying heat to a selected temperature) of the material in the mold to be between a determined nominal allotropic phase transformation temperature and a determined shifted allotropic phase transformation temperature, and while applying pressure to the material in the mold and with the temperature of the material between the nominal allotropic phase transformation temperature and the shifted allotropic phase transformation temperature, applying a magnetic field to the material to cause the material to transform between a first allotrope phase and a second allotrope phase. The method also includes determining that the density of the material satisfies a density threshold. Optionally, the magnetic field may be applied to the material via magnetic cycling to adjust the magnetic field to a first strength of magnetic field and then to a second strength of magnetic field, and repeating the cycling between strengths of the magnetic field multiple times until the material transforms and achieves a desired density threshold.

The present invention also provides a method for densifying a material including arranging the material in the cavity of a mold, applying pressure to the material in the mold, and while applying pressure to the material in the mold, adjusting the temperature of the material, causing the material to transform between a first allotrope phase and a second allotrope phase. The method further includes determining that the desired density of the material is achieved.

Optionally, the present invention includes, after determining that the desired density of the material is achieved, further adjusting the temperature of the material, causing the material to undergo annealing. Optionally, adjusting the temperature of the material includes heating the material using induction heating.

These and other objects, advantages, purposes and features of the present invention will become more apparent upon review of the following specification in conjunction with the drawings.

DESCRIPTION OF THE PREFERRED EMBODIMENTS

Figure 1:
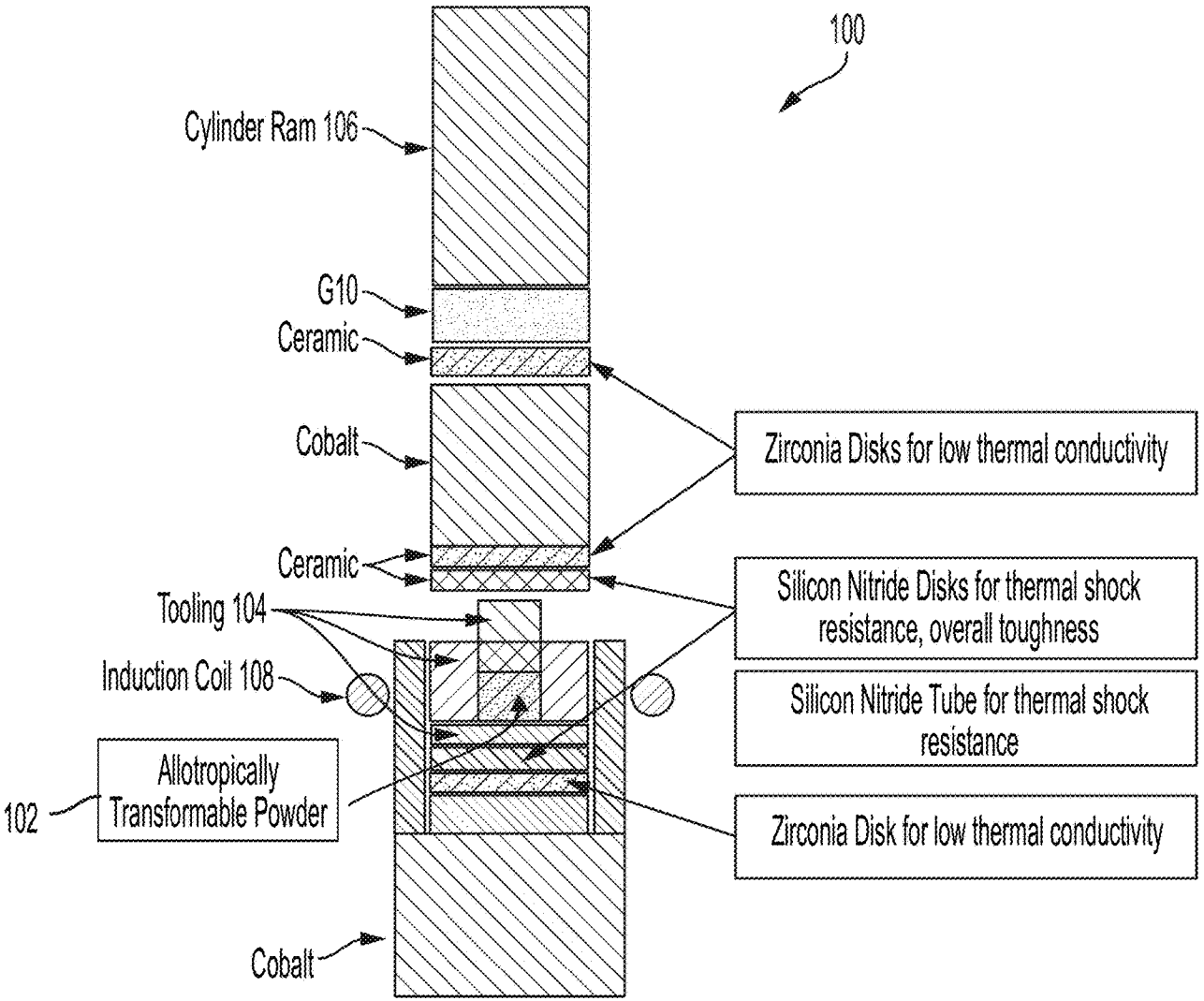
FIG. 1 is a side view of a system for material densification.

The present invention relates to a process for densifying a material that exhibits allotropic transformation (e.g., ceramics such as silicon nitride, but more specifically titanium and titanium alloys) far below the melt temperature of the material(s). The process densifies the material into near-net-shape components using thermal and/or magnetic cycling. The resulting near-net-shape components require little machining to create final products, resulting in less waste than traditional methods. The cycling may be performed under less demanding conditions than traditional methods, such as at temperatures far below the melting temperature of the material and at more readily achievable pressures. The process may also take less time and/or energy than traditional methods, while producing final products with similar or superior material and/or mechanical properties. Furthermore, the process may be applied to low-cost raw materials (e.g., powders created for the additive manufacturing industry with grain sizes unsuitable for use by 3D printers), or titanium sponge powder or the like, thereby reducing the cost of production.

The process of thermal and/or magnetic cycling transforms the material from one allotrope phase to another allotrope phase. Each allotrope consists of atoms bonded together in a characteristic arrangement having associated characteristic physical properties. For example, the titanium molecules in the alpha titanium ($\alpha$) allotrope form a hexagonal close packed structure. In contrast, the titanium molecules in the beta titanium ($\beta$) allotrope form a less closely packed, body-centered cubic structure. For pure titanium, a reduction in volume as great as 8.1% may occur during the transformation (phase change) from the $\beta$ allotrope to the $\alpha$ allotrope. Furthermore, when sufficient pressure is applied to the material during a phase change from the $\beta$ allotrope to the $\alpha$ allotrope, the material undergoes compaction. For example, if the material undergoes a reduction in volume during a transition from the $\beta$ allotrope to the $\alpha$ allotrope and subsequently transitions back to the $\beta$ allotrope while under sufficient pressure, the material does not simply return to the previous volume associated with the $\alpha$ allotrope. Instead, the material may expand to fill voids, or otherwise become more dense or compact. Therefore, iteratively cycling the material between allotrope phases, while applying sufficient pressure to the material, results in stepwise densification. The process may be repeated until a suitable density is achieved (i.e., a density associated with desired material and/or mechanical properties). For example, the process may be repeated 10-12 times until the material is greater than 99.9999% dense. Furthermore, the material may be contained in a form or mold during the densification process (e.g., a mold approximating the shape of a final product). In this case, the densification process produces near-net-shape components requiring little machining to create final products with desired material/mechanical properties.

Referring now to the drawings and the illustrative embodiments depicted therein, FIG. 1 shows an example of a system 100 for densifying allotropically transformable materials 102. The system includes tooling 104, such as a mold or form, into which the material is introduced. Optionally, the material (e.g., powdered metal alloy, powdered ceramic, or the like) is introduced into the form or mold, then placed in a vacuum environment where the material is "skinned" (e.g., by using an electron beam to melt the outside of the material, creating a barrier to keep out oxygen or other contaminants). The process may utilize aspects disclosed in U.S. Publication No. US-2017-0095861, which is hereby incorporated herein by reference in its entirety.

The tooling may include a base mold having a near-net-shape cavity (e.g., suggesting or approximating the shape of a final product) and an upper die or plate capable of applying pressure to the material contained in the base mold. Alternatively, the tooling may include a substantially planar base plate supporting a perimeter mold containing the material and an upper plate capable of applying pressure to the material contained in the perimeter mold. Other tooling configurations are possible. For instance, the mold and/or tooling may consist of several pieces that can be disassembled after the component is processed (e.g., to facilitate removal of components with complex geometries).

The system is operable to apply pressure to the material contained in the tooling (e.g., via a hydraulic or pneumatic ram assembly 106). Here, the system includes a cylinder ram assembly disposed above the tooling and capable of applying downward pressure (e.g., uniaxial pressure) to the material via the tooling (e.g., applying pressure to the upper plate of the tooling, the upper plate, in turn, transmitting the pressure to the material). For material consisting of titanium or titanium alloy, the applied pressure may be in the range from 1 MPa to 1,000 MPa, and preferably about 50 MPa. The ram assembly includes layers or portions that perform additional functions while also transmitting and applying pressure to the material. These additional functions include providing thermal isolation between layers of the ram assembly or between layers of the ram and the tooling/material, conforming the ram assembly to a surface of the tooling, or the like. The ram assembly and the tooling may include portions consisting of ferrous and non-ferrous materials including, but not limited to, steel, stainless steel, molybdenum, tungsten, cobalt, or any combination thereof, and/or ceramics including, but not limited to, silicon nitride, silicon carbide, alumina, boron nitride, Zirconia, or any combination thereof.

Optionally, the ram assembly include one or more extensometers, pressure sensors, and/or position sensors. The position sensors may include an encoder, linear variable differential transformer (LVDT), or other sensor or sensor combination capable of accurate measurement in the environment. For example, a sensor may monitor the position of the ram progressively moving to a lower position, indicating a change in one or more dimensions of the material as the density of the material increases (accounting for other relevant parameters, such as temperature and allotropic composition of the material). The sensors may determine that the ram has moved to a position indicating that a desired material density has been achieved (e.g., taking into account the weight of the material and the volume of the mold).

Alternatively, the position sensors may determine that the ram has stopped moving to a lower position during the densification process (or is moving by an amount less than a threshold distance), indicating that the desired material density has been achieved. An extensometer (e.g., an optical distance sensor capable of resolving distances of $10^{-6}$ meters) may be used to measure the position of the ram, as described above, or to measure deformation of the material (e.g., as a function of pressure applied by the ram). In this way, the sensors indicate when the material has achieved a threshold density (e.g., at least 99.999%) so that the final product will have suitable structural and/or mechanical properties.

The system is also operable to adjust the temperature of the material. Here, the system includes an induction-heating system 108. The induction-heating system generates time-varying electromagnetic fields that induce eddy currents in the electrically conductive tooling and/or material. The induced eddy currents flow through the resistive tooling or material, generating heat. Heat generated in the tooling is thermally conducted to the material in contact with and contained within the tooling. Optionally, the tooling consists of a semiconductor ceramic, such as silicon nitride doped with titanium nitride. Above a particular temperature, the semiconductor ceramic ceases to be electrically conductive. Therefore, eddy currents are not induced in the semiconductor ceramic tooling above that temperature. In this way, the tooling may be configured to self-limit the range of temperature adjustment of the material.

Alternatively, the temperature of the material may be adjusted by applying electrical current directly to the resistive tooling, or by applying electrical current to resistive cartridges in contact with the tooling or the material, or by wrapping the tooling in heating "blankets," or "pads." The temperature of the material may be adjusted by applying infrared radiation, heat from a flame, or other suitable heat source. Optionally, the system provides for monitoring the temperature of the material using one or more thermocouples (TC), resistive temperature detectors (RTD), infrared temperature detectors (IR), or any other contact or non-contact style temperature sensor capable of accurate measurement in the environment. An operator may use the temperature measurements from the sensor(s) to manually adjust the temperature of the material.

Figure 2:
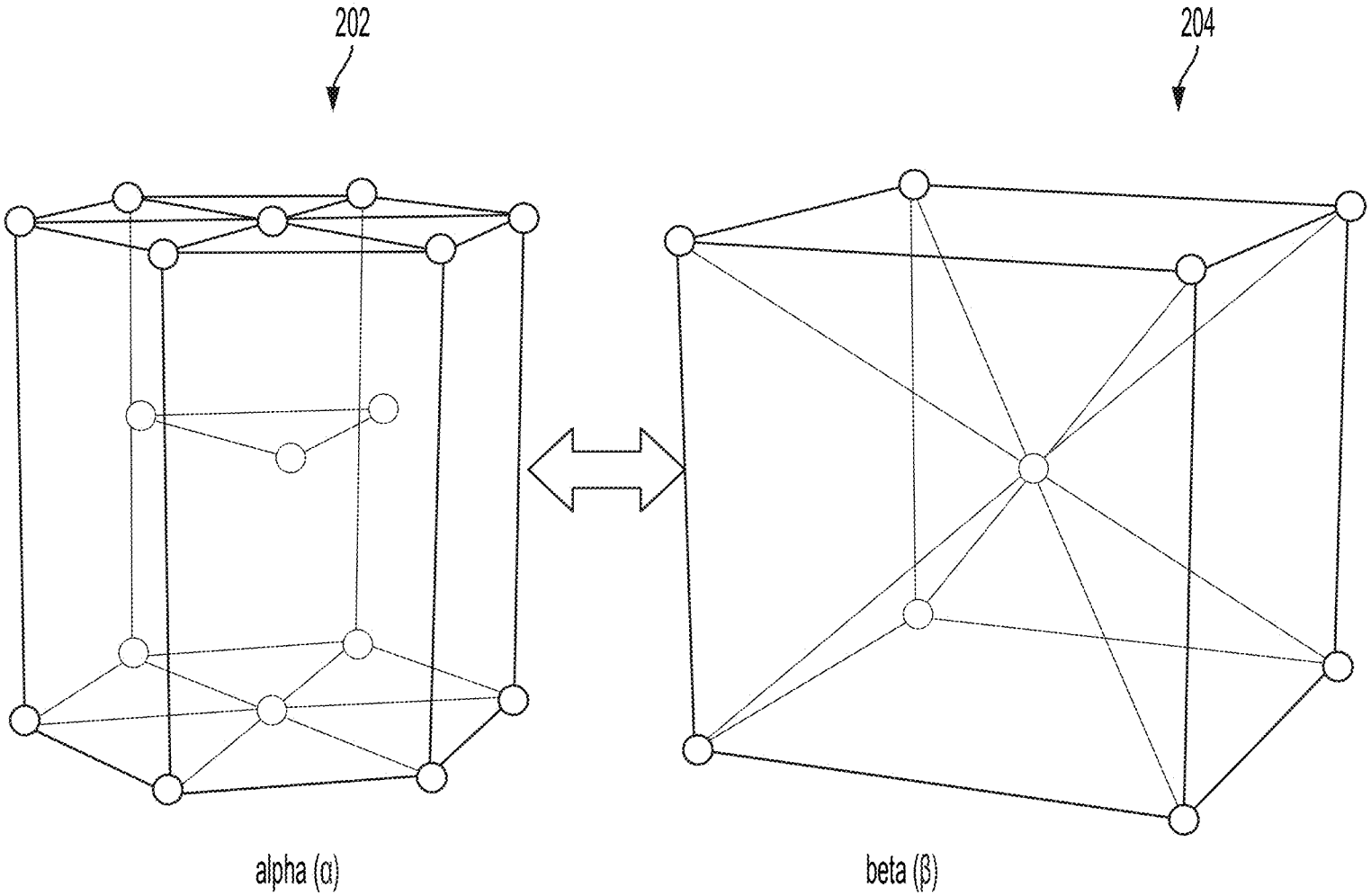
FIG. 2 is a perspective view of atomic arrangement of allotropes.

Alternatively, the system may provide automatic temperature control based on the temperature measurements, using an automatic control algorithm such as a proportional-integral-derivative (PID) loop or the like to achieve a target or desired material temperature. The temperature of the material may be adjusted up and down repeatedly, or "cycled" over time between values such that the material transforms back and forth between different allotrope phases. For example, a titanium alloy may transform to the alpha titanium (α) allotrope at a temperature less than 882 degrees C. (1620 degrees F.) and to the beta titanium (13) allotrope at a temperature greater than 882 degrees C. (the α allotrope having a hexagonal close-packed structure (see 202 in FIG. 2), and the β allotrope having a body centered cubic structure (see 204 in FIG. 2)). Furthermore, the temperature of the material may be cycled over time between values such that the material transforms between a state consisting primarily of one allotrope and another state consisting of two or more allotropes (e.g., having substantial amounts of each of the two or more allotropes).

The densification process described above is effective when the material completely transforms from one allotrope to another during temperature cycling. Furthermore, the densification process is also effective when a significant or merely a non-trivial amount of the material transforms to another allotrope during temperature cycling. The number of cycles or iterations required to achieve the desired densification, however, may depend on the proportion of the material undergoing allotropic transformation (as well as the relative spacing of atoms in each allotrope, and other factors). That is, if only a small percentage of the material transforms to another allotrope during temperature cycling, more cycles may be required than if a larger percentage of the material transforms to the other allotrope. For example, and with reference to FIG. 3A, graphs 300 show allotropic phase diagrams of titanium and titanium alloys. In the example of commercially pure titanium containing nearly zero oxygen, the allotropic transformation temperature is 882 degrees C. Below 882 degrees C., the titanium consists primarily of the alpha titanium (α) allotrope. Above 882 degrees C., the titanium consists primarily of the beta titanium (13) allotrope.

Figures 3A, 3B:
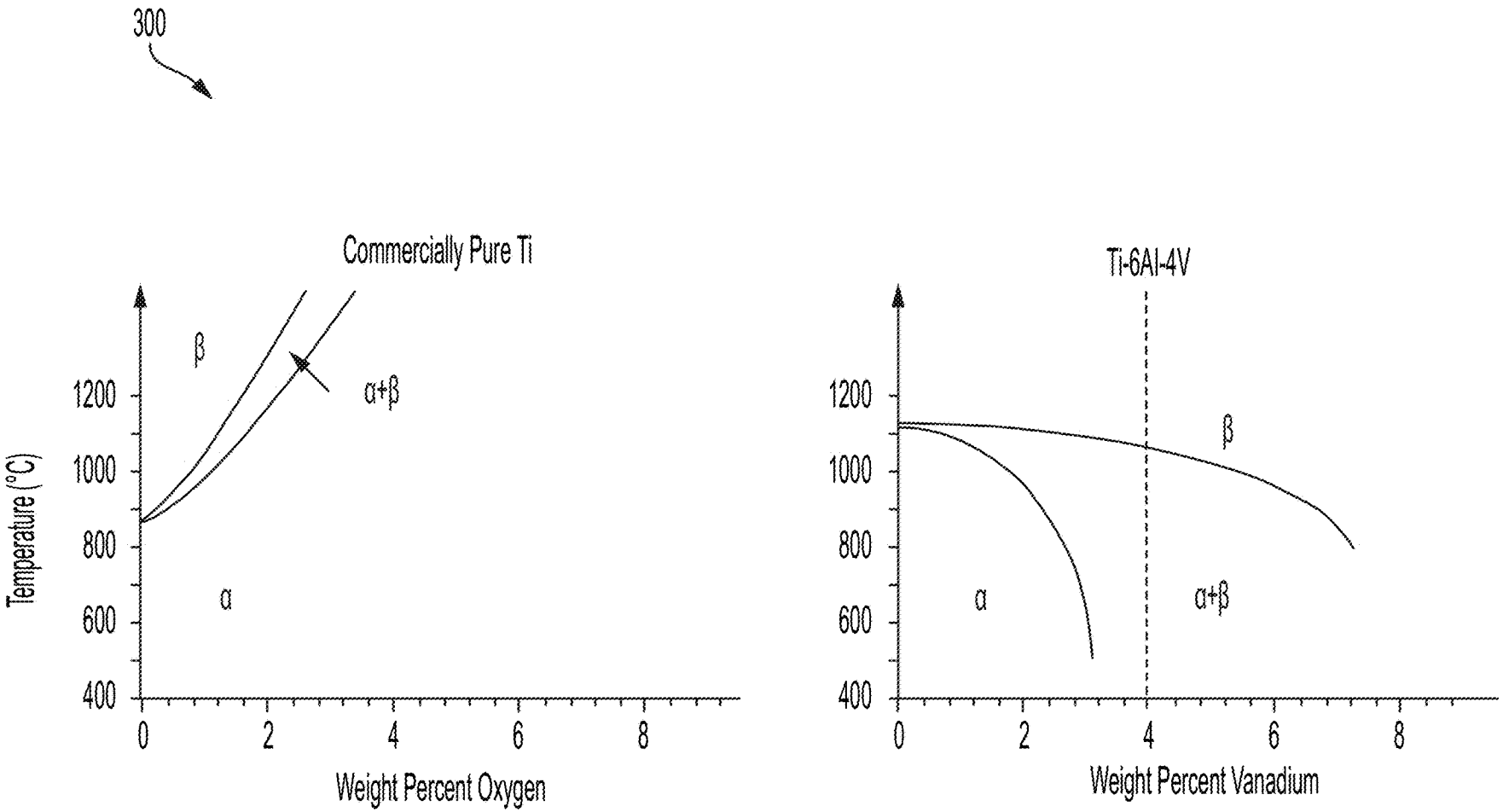
FIGS. 3A and 3B are schematic graphs of allotropic phase.

Cycling the temperature above and below the allotropic transformation temperature causes the titanium to transform between α and β allotropes. As the Oxygen content of the titanium increases, the transformation between primarily alpha titanium (α) and primarily beta titanium (β) occurs over an increasingly large temperature range, referred to as the transus phase. That is, at certain temperatures, the titanium consists of both alpha titanium (α) and beta titanium (β). The transus phase is indicated in FIG. 3A as (α+β). Referring to FIG. 3B, the phase diagram of Titanium-Vanadium alloys is shown. As the Vanadium content of the alloy increases, the transformation between alpha titanium (α) and beta titanium (β) also occurs over an increasingly large temperature range. In the particular example of the Titanium/Aluminum/Vanadium alloy Ti-6Al-4V, there is no temperature at which the alloy comprises primarily the a allotrope. Instead, at temperatures above the allotropic transformation temperature (e.g., approximately 1050 degrees C.), Ti-6Al-4V comprises primarily the β allotrope. At temperatures below the allotropic transformation temperature, Ti-6Al-4V consists of significant amounts of both α and β allotropes. Cycling the temperature above and below the allotropic transformation temperature effects a transformation between the transus (α+β) state and the β state of the alloy. Therefore, the present invention may effectively densify Ti-6Al-4V.

Figure 4A:
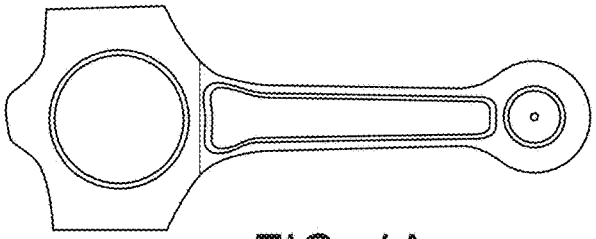
FIG. 4A-4C are side views of a formed part.
Figure 4B:
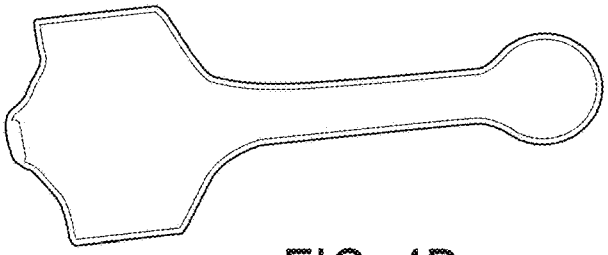
Figure 4C:
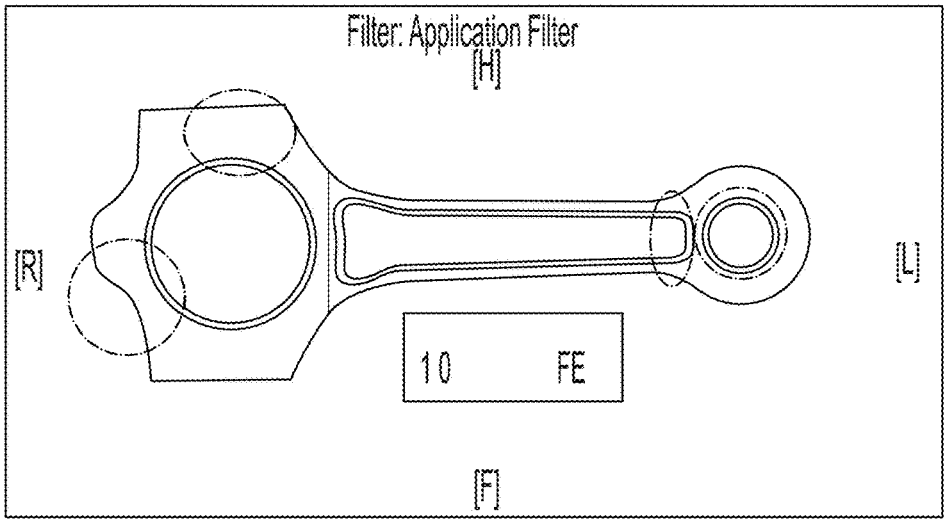
Figure 4D:
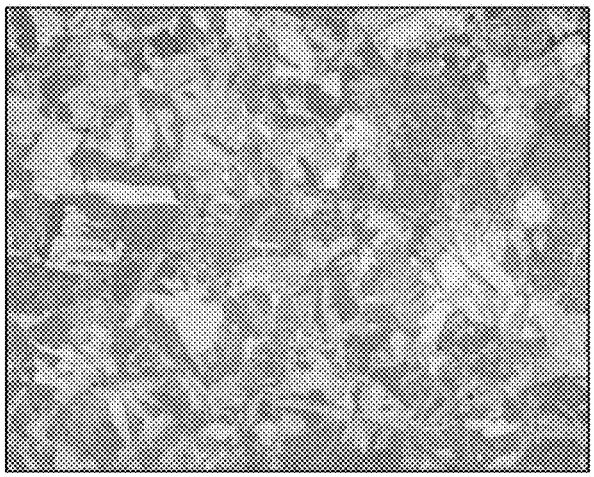
FIG. 4D is a magnified view of a cross section of a formed part.

Referring to FIGS. 4A-D, metallurgic analysis of a titanium connecting-rod blank created from Ti-6Al-4V powder using the thermal cycling method indicates greater than 99.999% density and uniform grain structure. FIG. 4A shows the titanium connecting-rod blank; FIG. 4B shows the inside of the connecting rod blank cut in half for analysis; FIG. 4C shows an x-ray of the connecting rod; and FIG. 4D shows the magnified grain structure.

Figure 5:
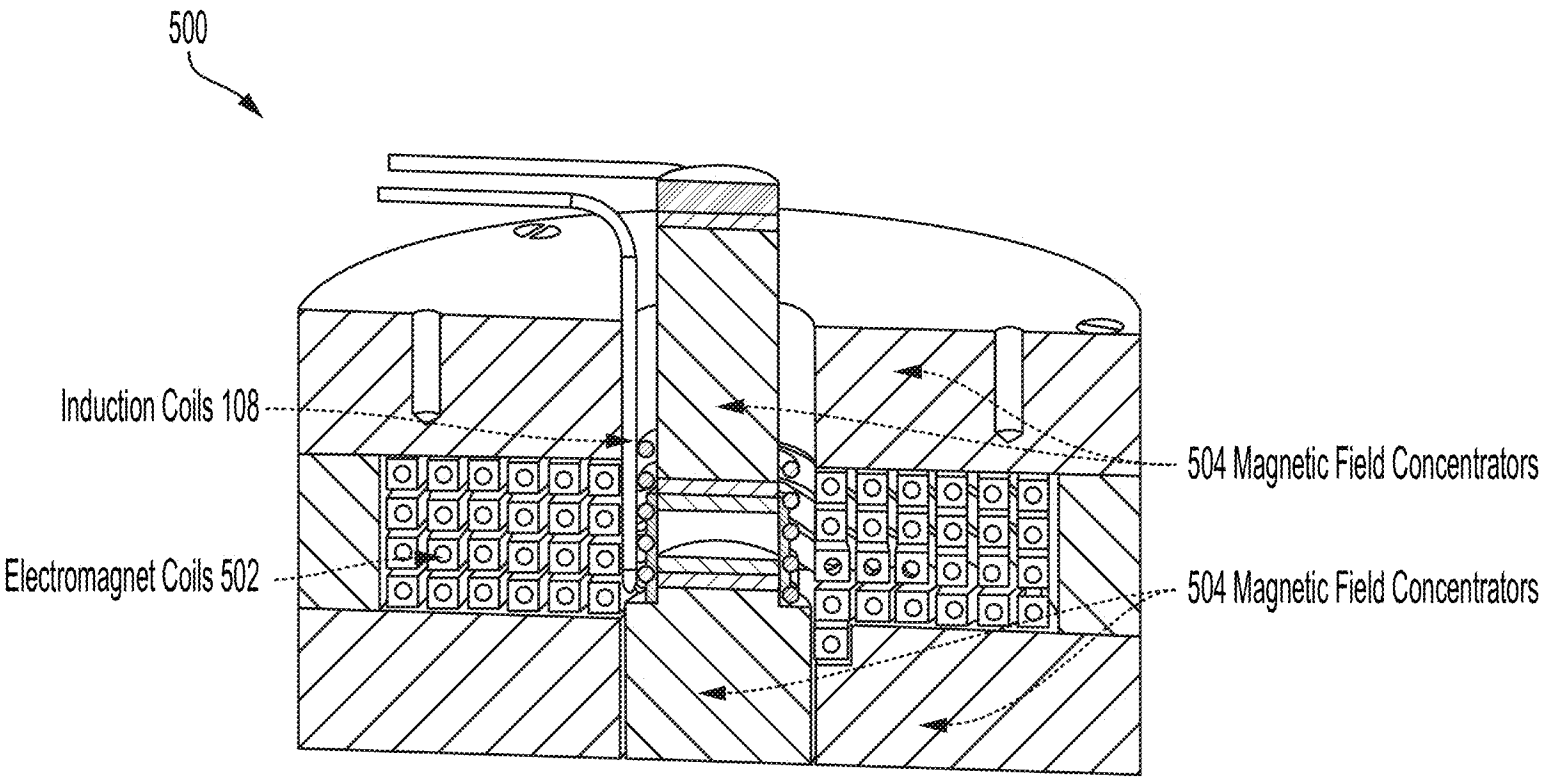
FIG. 5 is a perspective view of an electromagnet system.

Referring now to FIG. 5, the system is optionally operable to apply a magnetic field to the material. The magnetic field may be between 0.2 and 9 Tesla and preferably between 1 and 2 Tesla. Applying a strong magnetic field to titanium and titanium alloys can shift the temperature at which the allotropic phase change occurs. Here, the system includes an electromagnet 500 consisting of electromagnetic coils 502 disposed around the circumference of the tooling. The coils are arranged to conduct electrical current in a substantially horizontal plane, perpendicular to the direction of motion of the ram. The coils may be actively cooled to remove heat generated by the relatively large electrical current. Alternatively, a superconducting magnet may be used. The magnet coils and induction-heating coils are separate due to their different electrical requirements. The magnetic flux of the electromagnet is further shaped or controlled by field concentrators 504. The coils are surrounded on three sides by a ferromagnetic material, such as iron. As shown in FIG. 1, cobalt field concentrators are disposed above and below the material and tooling. Layers of low-thermal-conductivity zirconia are disposed above and below the cobalt field concentrators to provide thermal isolation. That is, the ram assembly includes portions of cobalt that shape and control the magnetic field in addition to transmitting pressure from the ram to the material and tooling.

Figure 6:
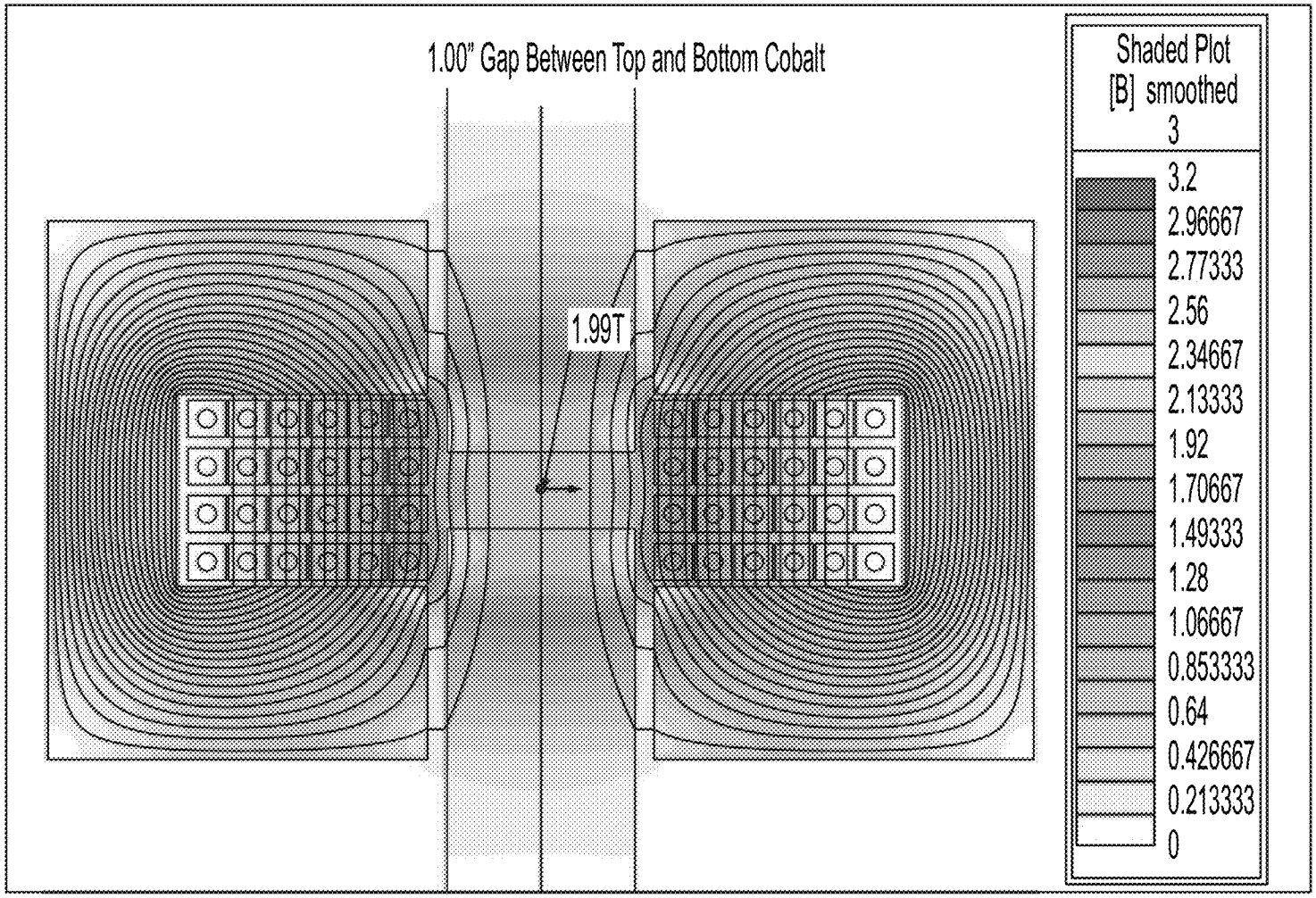
FIG. 6 is a side view of a magnetic flux map of an electromagnet system.

Referring now to FIG. 6, a magnetic field strength analysis 600 shows (in a cross-sectional view cutting through the center of the tooling) the magnetic flux lines produced by the electromagnet and further shaped or controlled, e.g., by the cobalt field concentrators disposed above and below the material. In this analysis, the distance between the field concentrators in 1 inch. A false-color (greyscale) image shows the field strength in and around the electromagnet, including the material and tooling. Here, the field strength in the center of the material is approximately 2T.

Figure 7A:
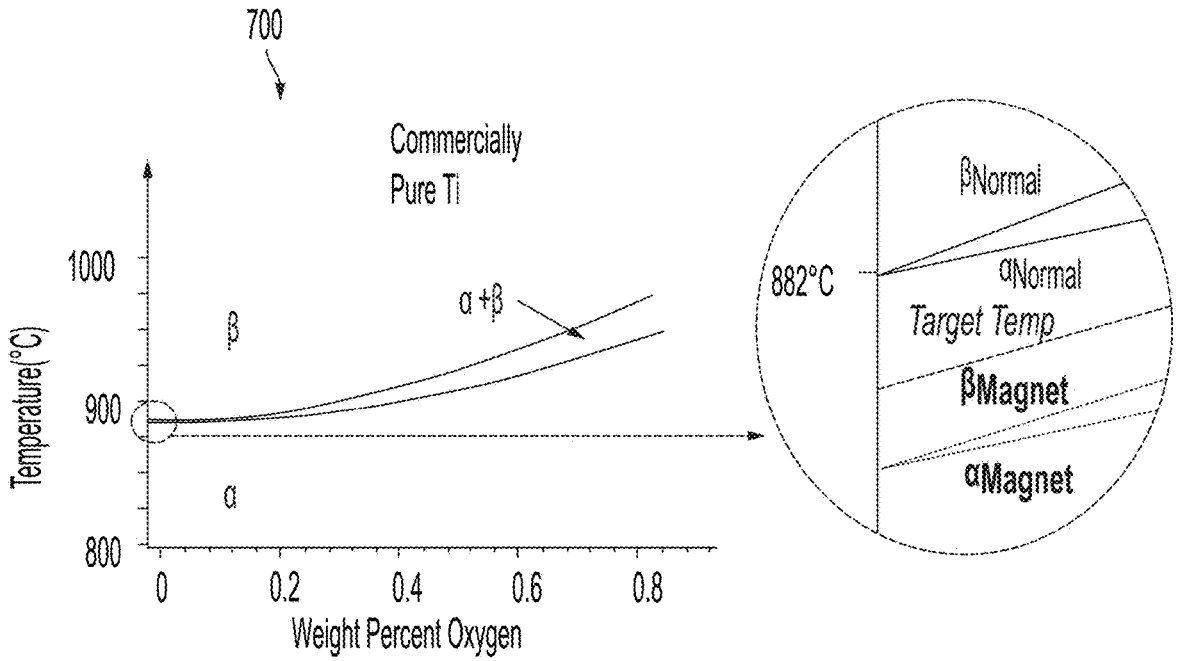
FIGS. 7A and 7B are schematic graphs of allotropic transformation temperature with and without applied magnetic field.
Figure 7B:
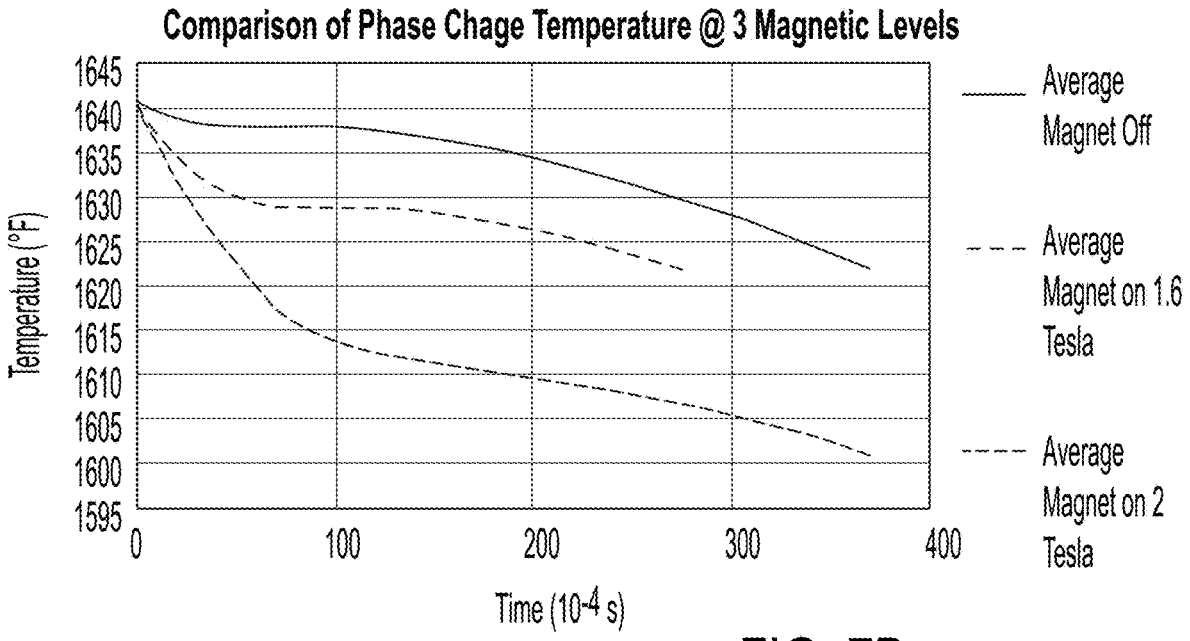

Referring now to FIG. 7A, a comparison 700 of the change in temperature versus change in weight percent of Oxygen for commercially pure Titanium with and without a strong magnetic field applied, shows that when the magnetic field is applied, the allotropic transformation temperature of grade 2 commercially pure titanium sponge powder is decreased from its nominal value of 882 degrees C. Referring now to FIG. 7B, experimental data (showing change in temperature versus time with a magnet on and with a magnet off) shows a relative decrease of as much as 25 degrees F. in the allotropic transformation temperature of grade 2 commercially pure titanium when the magnetic field is applied.

The temperature of the material, therefore, may be maintained at a target temperature between the nominal allotropic transformation temperature and the decreased allotropic transformation temperature. The magnetic field may then be cycled on and off, causing the material to transform between allotropic states at the constant (or substantially constant) temperature. Here, when the magnet field is applied to the material at the target temperature, the material transforms to the β allotrope. When the magnet field is cycled off, the material transforms to the α allotrope.

Therefore, cycling the magnetic field on and off at while the material is at the target temperature effects a transformation between titanium allotrope phases. Thus, titanium may be effectively densified by the present invention using magnetic cycling, with or without temperature cycling. Transformations between α and β-phases tend to be exothermic or endothermic. With titanium, this transformation tends to produce approximately 90 kilojoules per kilogram of material. That is, the amount of heat released or absorbed by the material is proportional to the mass of the material. The time between successive magnetic cycles is sufficiently long for the system to maintain the material at the target temperature. The time between magnetic cycles may still be shorter than the time required for temperature cycling, reducing the overall time to achieve the desired density, particularly for less massive parts and less demanding densities (e.g., greater than 99.9%).

Figure 8:
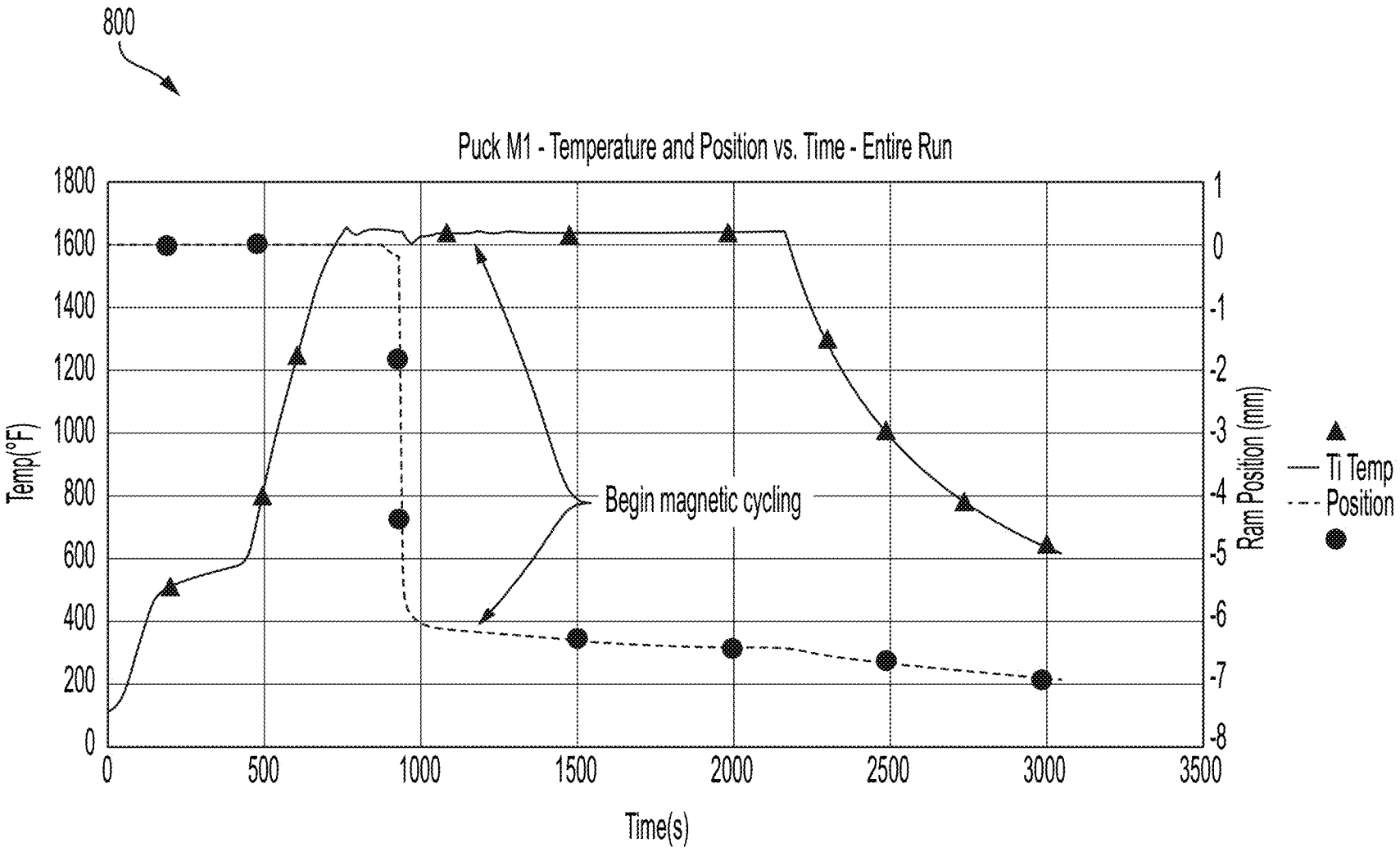
FIG. 8 is a schematic graph of the temperature and density of a material undergoing densification.

Referring now to FIG. 8, a graph 800 plots experimental data showing the temperature profile and ram position (inversely related to material density) for the densification of commercially pure titanium powder using the magnetic cycling method. The graph shows the material temperature (shown in the trace denoted with triangles) adjusted up to the target temperature (approximately 1620 degrees F.). After the target temperature is achieved, pressure is applied to the material by the ram. As the pressure is applied, the ram moves downward approximately 0.006 mm from a nominal position (shown in the trace denoted with circles). The magnetic field is then cycled on and off over a period of approximately 500-1000 seconds, resulting in densification of the material and somewhat further downward motion of the ram. After the densification is complete, the material is allowed to cool.

Figure 9:
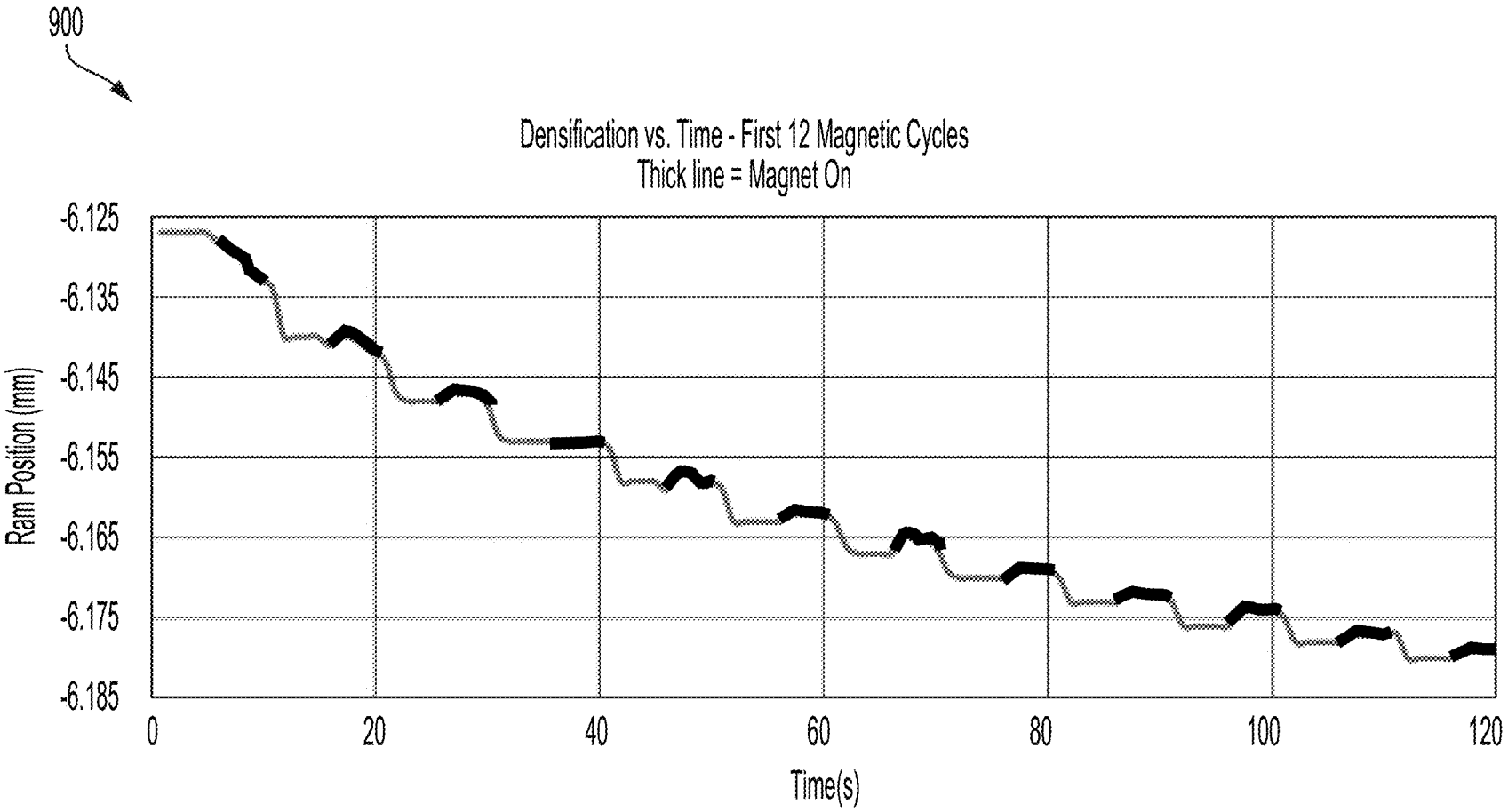
FIG. 9 is a schematic graph of the density of a material undergoing densification.
Figure 10:
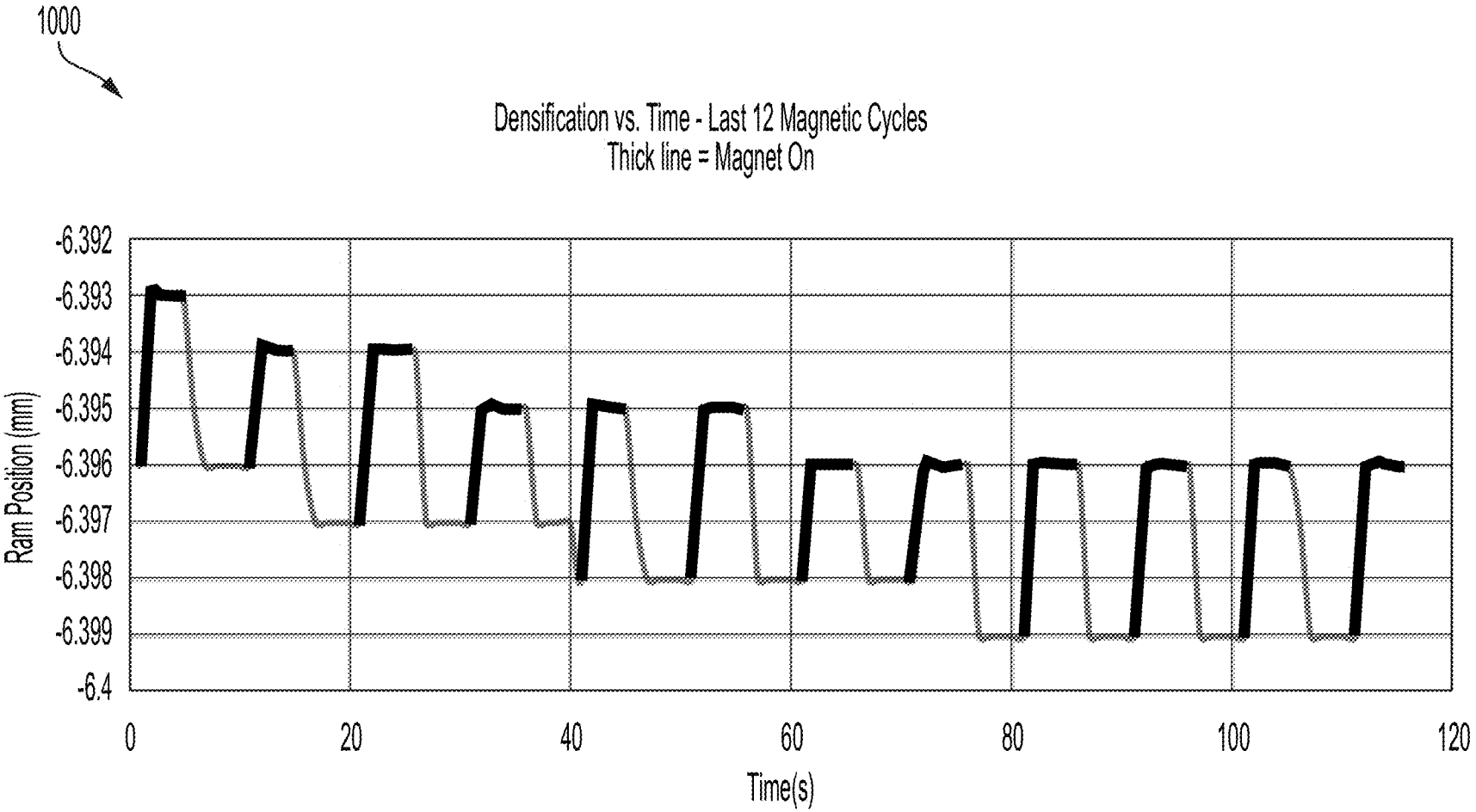
FIG. 10 is another schematic graph of the density of a material undergoing densification.

Referring now to FIG. 9, a graph 900 plots experimental data showing, in greater precision, the ram position for the first 12 magnetic cycles of the densification of commercially pure titanium powder. As can be more clearly seen at this scale, the ram moves approximately 0.055 mm during these first 12 magnetic cycles. The portion of the trace having a thinner line width indicates a period when the magnetic field was not applied and the portion having a thicker line width indicates when the magnetic field was applied. The thin-line periods represent the target temperature being below the (nominal) allotropic transformation temperature (and the powder transforming to the hexagonal close-packed a allotrope state). The thick-line periods represent target temperature being above the (reduced) allotropic transformation temperature (and powder transforming to the β allotrope state). The first magnetic cycle does not alter the volume due to the lack of density within the powder; whereas subsequent magnetic cycles produce a measurable change in volume, or even reverse dislocation of the cylinder ram. The denser the titanium, the more uniformity of ram motion there is between magnetic cycles. Referring now to FIG. 10, a graph 1000 plots experimental data showing, in even greater precision, the ram position for the last 12 magnetic cycles of the densification of commercially pure titanium powder. The ram moves only a few microns during these last 12 magnetic cycles. During the final four magnetic cycles, the ram position returns to the start location after the magnetic field has been removed, indicating the desired density has been achieved.

Figure 11:
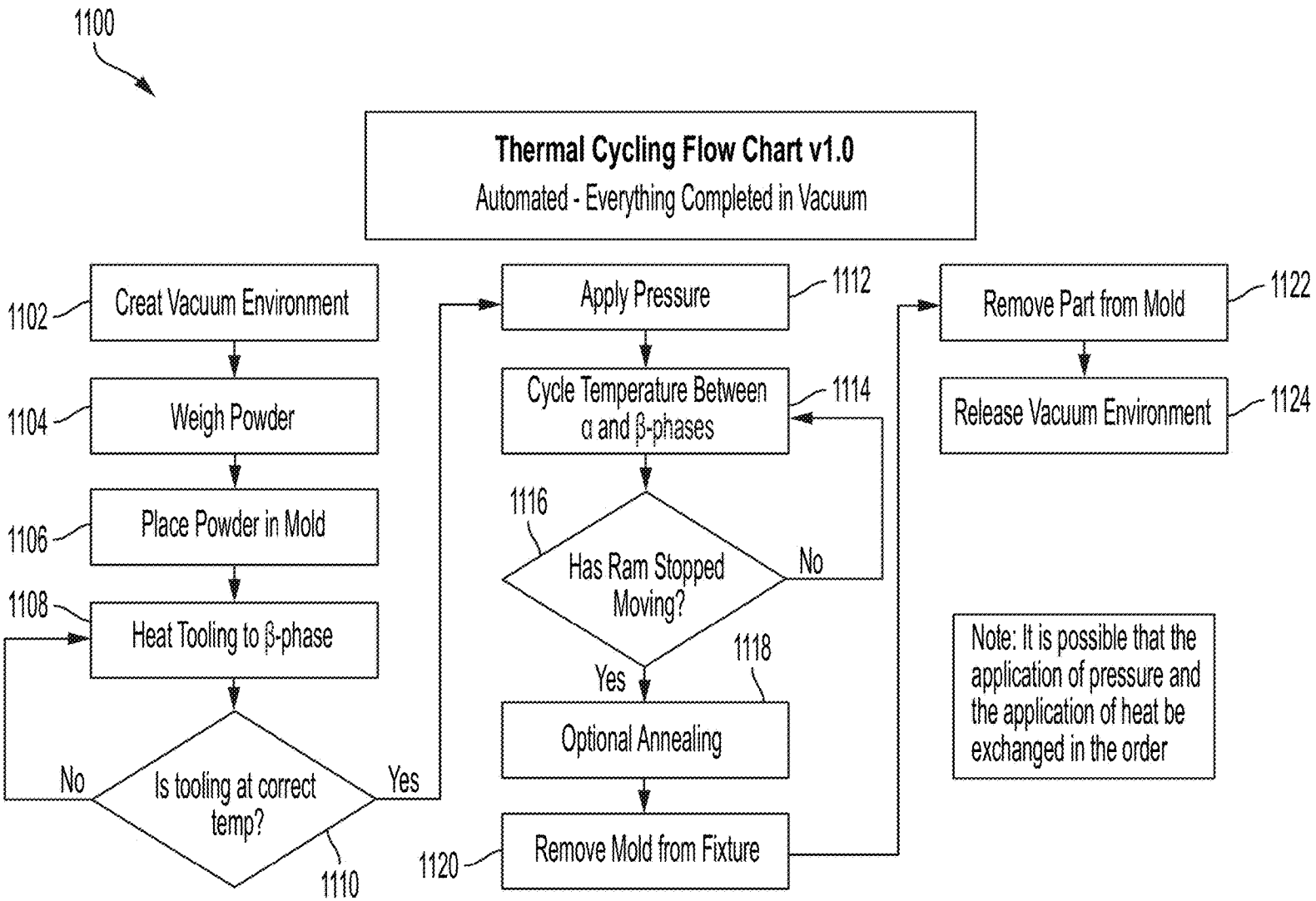
FIGS. 11-14 are graphical flowcharts of a process for material densification.

Referring now to FIG. 11, a graphical flowchart 1100 illustrates an approach for densifying allotropic material in accordance with the present invention using thermal cycling. At step 1102, a controlled atmosphere such as a vacuum of, preferably $10^{-2}$ Torr or better, is created. The allotropically transforming material (e.g., powdered metal alloy), along with all associated tooling are held in the controlled atmospheric environment (e.g., to avoid contamination of the material). At step 1104, the weight of the allotropically transformable material is determined. At step 1106, the material (e.g., powder) is placed in a form or the cavity of a mold. At step 1108, the temperature of the material is adjusted to a temperature associated with the β allotrope. At step 1110, the temperature of the tooling and material is measured and further adjusted, if necessary, to cause the material to transform to the β allotrope state. The temperature may be adjusted manually or automatically (e.g., using a PID algorithm). At step 1112, pressure is applied to the material (e.g., using a hydraulic ram applying uniaxially downward pressure). The steps of adjusting the temperature (1108 and 1110) and applying pressure (1112) may be exchanged in the order. At step 1114, the temperature of the tooling and material is cycled between temperatures causing the material to transform between α allotrope and β allotrope phases. At step 1116, the system determines that the hydraulic ram has stopped moving downward. Therefore, the desired density is achieved. Alternatively, for graphical flowchart 1100-1400 (FIGS. 11-14), the number of cycles to achieve the desired density can be determined through experimentation, so that the system determines that the density is achieved when the experimentally determined number of cycles have been performed, without monitoring movement of the hydraulic ram.

At step 1118, the temperature of the tooling and material is cycled between temperatures causing the material to undergo annealing. The temperatures associated with the annealing process are independent of the temperatures associated with the densification process. However, the annealing step may be performed using the same tooling and heat source as the densification process. At step 1118, after the densification and annealing is complete, the mold is removed from the system. At step 1120, the mold is removed from the fixture. Optionally, the mold is disassembled to facilitate removing the part (e.g., to accommodate parts having complex geometries). At step 1122, the part is removed from the mold. At step 1124, the controlled atmosphere is released.

Figure 12:
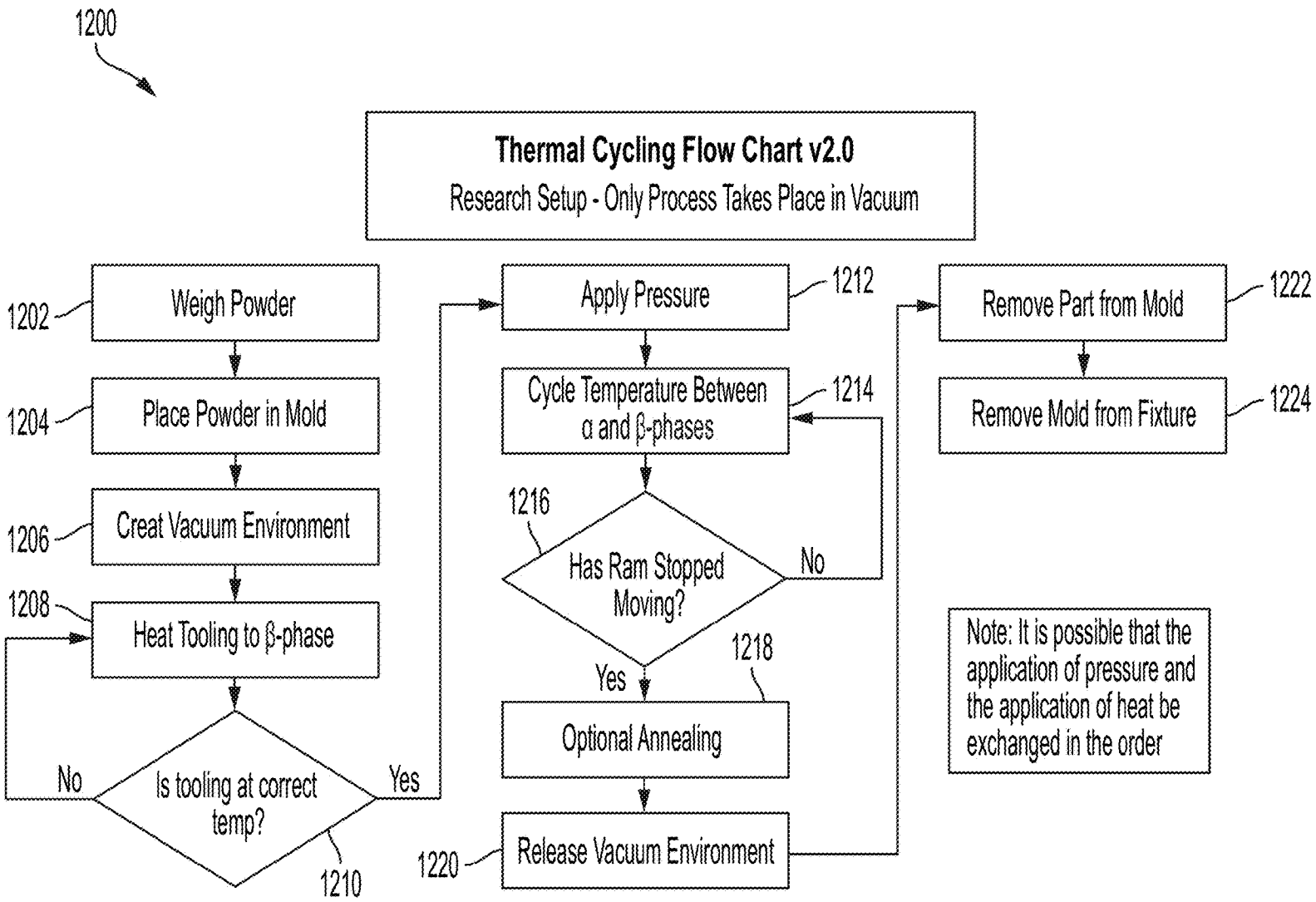

Referring now to FIG. 12, another graphical flowchart 1200 illustrates an approach for densifying allotropic material in accordance with the present invention using thermal cycling. At step 1202, the weight of the allotropically transformable material is determined. In contrast to FIG. 11, the weighing step is performed prior to placing the material in the mold or establishing a controlled environment. At step 1204, the material (e.g., powder) is placed in a form or the cavity of a mold. At step 1206, the controlled atmosphere (e.g., vacuum of, preferably $10^{-2}$ Torr or better) is created. The remaining steps of the graphical flowchart are substantially similar to corresponding steps shown in FIG. 11, with the exception that, because the vacuum environment is created (step 1206) after the powder is weighed (step 1202) and placed in the mold (step 1204), only the densification process (steps 1208, 1210, 1212, 1214, 1216, and 1218) takes place in the vacuum environment, and with the steps of applying pressure (step 1212) and initially adjusting the temperature (step 1208 and 1210) being exchangeable in the order.

Figure 13:
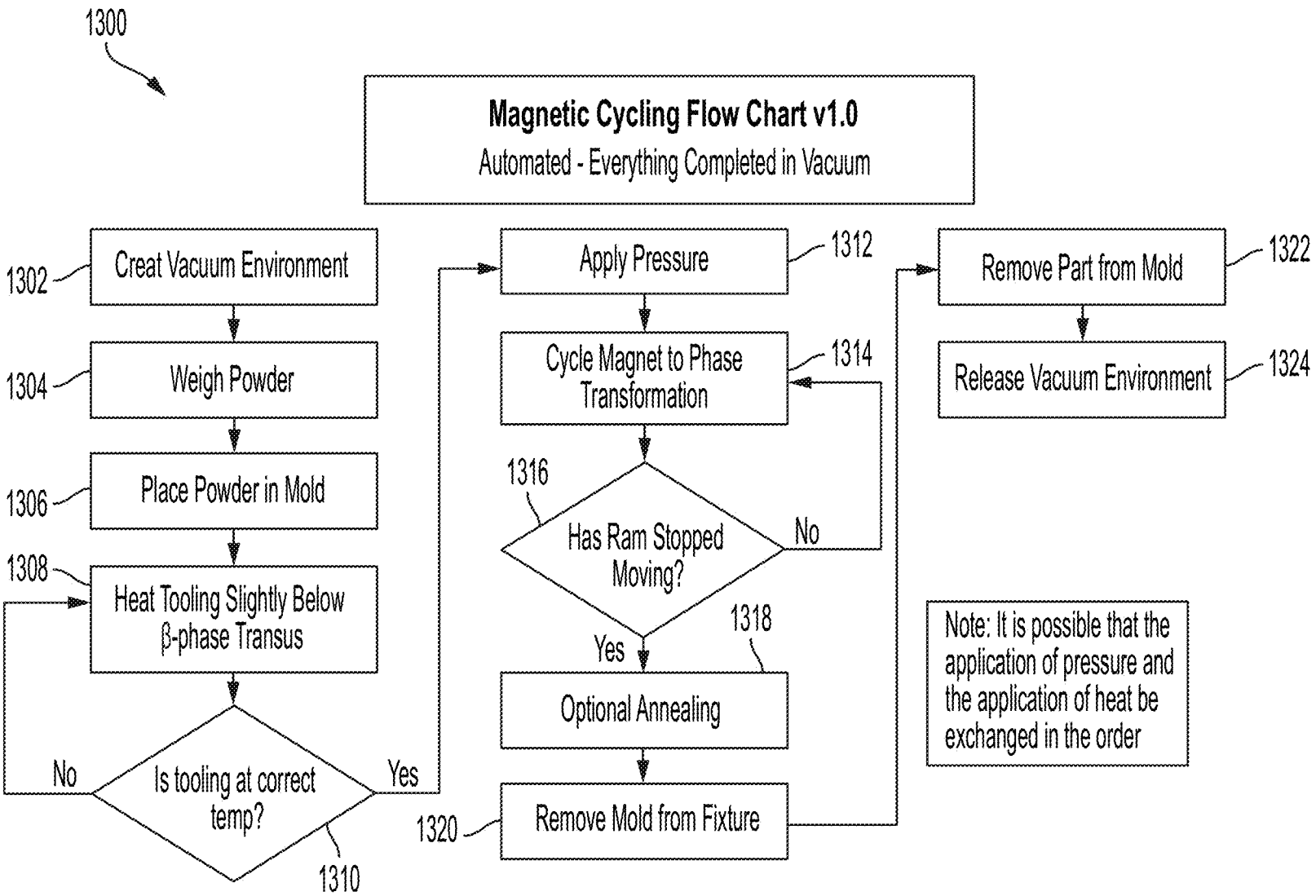

Referring now to FIG. 13, a graphical flowchart 1300 illustrates an approach for densifying allotropic material in accordance with the present invention using magnetic cycling. The flowchart is substantially similar to corresponding steps shown in the graphical flowchart shown in FIG. 11. However, instead of cycling the temperature of the tooling and material to cause the material to transform between α allotrope and β allotrope phases, at step 1314, a magnetic field is cycled, causing the material to transform between α allotrope and β allotrope phases or between α allotrope and α-β allotrope phases. In this case, the powdered metal alloy, the means to weigh the powder and place it in the mold, the uniaxial pressure device, the heating apparatus, the electromagnet, and/or an ejection system would all be held in the controlled atmosphere until the controlled atmosphere is released. The steps of adjusting the temperature (1308 and 1310) and applying pressure (1312) may be exchanged in the order.

Figure 14:
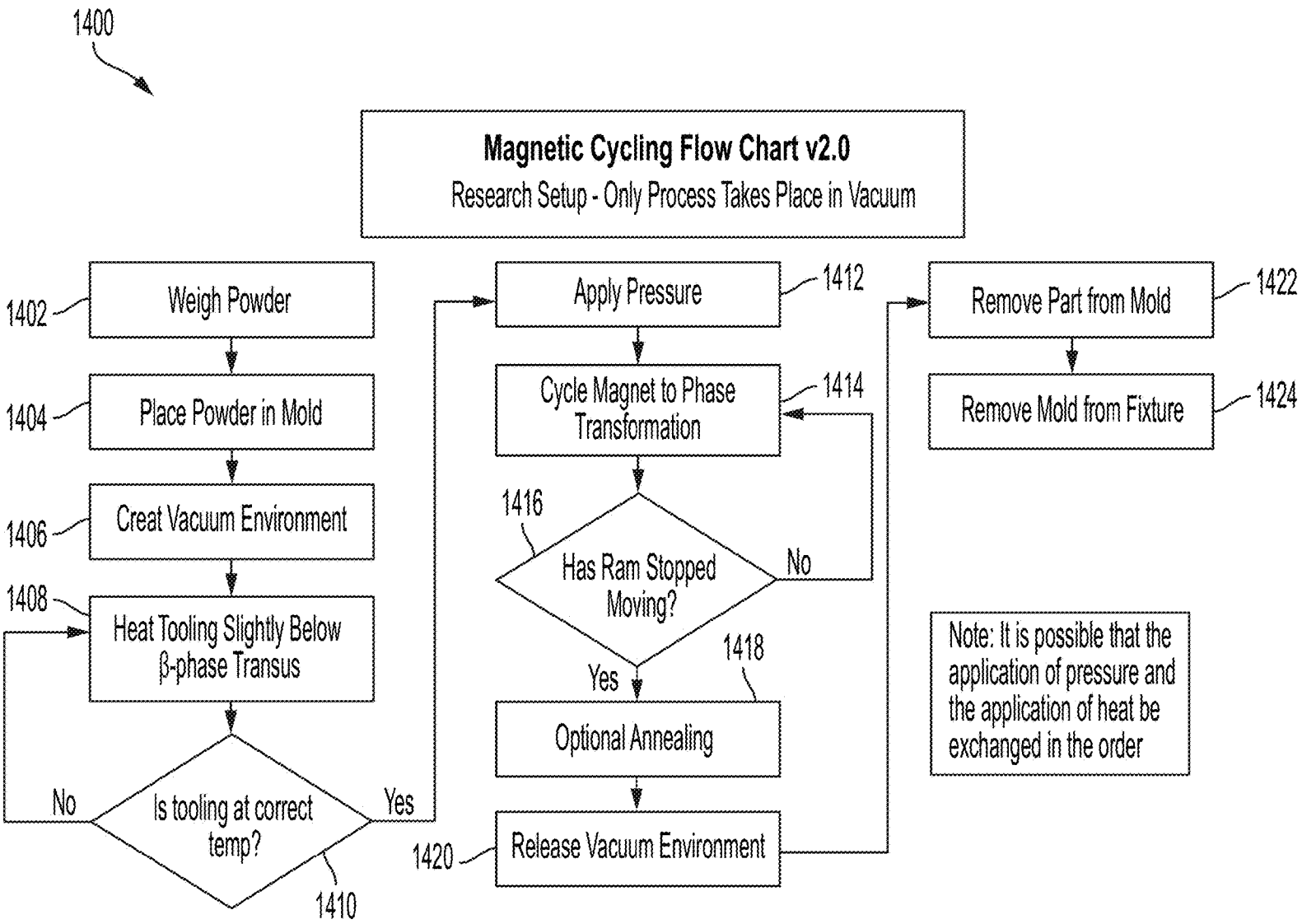

Referring now to FIG. 14, a graphical flowchart 1400 illustrates an approach for densifying allotropic material in accordance with the present invention using magnetic cycling. The flowchart is substantially similar to the graphical flowchart shown in FIG. 12. However, instead of cycling the temperature of the tooling and material to cause the material to transform between α allotrope and β allotrope phases or between α allotrope and α-β allotrope phases, at step 1414, a magnetic field is cycled, causing the material to transform between α allotrope and β allotrope phases. Additionally, similar to the graphical flowchart of FIG. 12, because the vacuum environment is created (step 1406) after the powder is weighed (step 1402) and placed in the mold (step 1404), only the densification process (steps 1408, 1410, 1412, 1414, 1416, and 1418) takes place in the vacuum environment, and with the steps of applying pressure (step 1412) and initially adjusting the temperature (steps 1408 and 1410) being exchangeable in the order.

Thus, the present invention provides a cost-effective process for densifying any material that exhibits allotropic transformation (e.g. metal alloys, such as Ti-6Al-4V), into a near-net-shape components using thermal and/or magnetic cycling. The thermal and/or magnetic cycling may repeat until the desired density is achieved. Optionally, the invention also provides for annealing the component (e.g., to remove internal stresses created by the densification process). The densification process produces near-net-shape components requiring little machining to create final products with desired material/mechanical properties.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A method for densifying a material that exhibits allotropic transformation, the method comprising:

arranging the material in a cavity of a mold;

applying pressure to the material in the mold;

while applying pressure to the material in the mold, applying a magnetic field to the material in the mold to cause the material to transform between a first allotrope phase and a second allotrope phase;

wherein applying the magnetic field to the material comprises magnetic cycling the magnetic field to cause the material to transform between the first allotrope phase and the second allotrope phase, and wherein magnetic cycling comprises one or more iterations of (i) adjusting the magnetic field to a first strength of magnetic field and then (ii) adjusting the magnetic field to a second strength of magnetic field;

determining a density of the material during the magnetic cycling of the magnetic field at least in part via determining that a threshold number of iterations of magnetic cycling of the magnetic field has occurred; and responsive to the threshold number of iterations of magnetic cycling of the magnetic field occurring, stopping the magnetic cycling of the magnetic field.

2. The method of claim 1, further comprising (i) determining a nominal allotropic phase transformation temperature where, in the absence of the magnetic field, the material transforms between the first allotrope phase and the second allotrope phase, and (ii) determining a shifted allotropic phase transformation temperature where, in the presence of the magnetic field, the material transforms between the first allotrope phase and the second allotrope phase, and (iii) maintaining a temperature of the material in the mold between the nominal allotropic phase transformation temperature and the shifted allotropic phase transformation temperature while applying pressure and the magnetic field to the material.

3. The method of claim 1, wherein the first strength of magnetic field comprises an off state of the magnetic field and the second strength of magnetic field comprises an on state of the magnetic field.

4. The method of claim 1, wherein the second strength of magnetic field is greater than 0.2 Tesla.

5. The method of claim 2, wherein maintaining a temperature of the material comprises heating the material to a target temperature using induction heating.

6. The method of claim 1, further comprising exposing the material to a vacuum environment.

7. A method for densifying a material that exhibits allotropic transformation, the method comprising:

arranging the material in a cavity of a mold;

applying pressure to the material in the mold;

while applying pressure to the material in the mold, applying a magnetic field to the material in the mold to cause the material to transform between a first allotrope phase and a second allotrope phase;

wherein applying the magnetic field to the material comprises magnetic cycling the magnetic field to cause the material to transform between the first allotrope phase and the second allotrope phase, and wherein magnetic cycling comprises one or more iterations of (i) adjusting the magnetic field to a first strength of magnetic field and then (ii) adjusting the magnetic field to a second strength of magnetic field;

determining a density of the material during the magnetic cycling of the magnetic field;

responsive to determination that the determined density of the material reaches a threshold density, stopping the magnetic cycling of the magnetic field; and wherein the magnetic field applied to the material is directed or intensified by a field concentrator.

8. The method of claim 7, wherein determination that the determined density of the material reaches the threshold density comprises determining that a change in a dimension of the material satisfies a threshold dimensional change.

9. The method of claim 7, further comprising, responsive to determination that the determined density of the material reaches the threshold density, adjusting a temperature of the material to cause the material to undergo annealing.

10. The method of claim 7, wherein applying pressure to the material in the mold comprises applying uniaxial pressure via a ram assembly.

11. The method of claim 1, wherein the material comprises a powdered ceramic or a powdered metal alloy.

12. The method of claim 1, wherein the material comprises Ti-6Al-4V.

13. The method of claim 1, wherein the cavity comprises a near-net-shape cavity defining a shape of a final product.

14. The method of claim 1, further comprising, responsive to stopping the magnetic cycling of the magnetic field, removing a densified part from the mold.

15. The method of claim 2, wherein the shifted allotropic phase transformation temperature is less than the nominal allotropic phase transformation temperature by at least 25 degrees Fahrenheit.

16. The method of claim 5, wherein the mold comprises an electrically conductive material, and wherein heating the material to the target temperature using induction heating comprises applying the magnetic field to the electrically conductive material to generate heat in the mold.

17. The method of claim 16, wherein the electrically conductive material ceases to be electrically conductive above the target temperature.

18. A method for densifying a material that exhibits allotropic transformation, the method comprising:

arranging the material in a cavity of a mold;

applying pressure to the material in the mold, wherein applying pressure to the material in the mold comprises applying uniaxial pressure via a ram assembly;

while applying pressure to the material in the mold, applying a magnetic field to the material in the mold to cause the material to transform between a first allotrope phase and a second allotrope phase;

wherein applying the magnetic field to the material comprises magnetic cycling the magnetic field to cause the material to transform between the first allotrope phase and the second allotrope phase, and wherein magnetic cycling comprises one or more iterations of (i) adjusting the magnetic field to a first strength of magnetic field and then (ii) adjusting the magnetic field to a second strength of magnetic field; and responsive to determination that the ram assembly has ceased movement during magnetic cycling of the magnetic field, stopping the magnetic cycling of the magnetic field.

19. The method of claim 18, further comprising (i) determining a nominal allotropic phase transformation temperature where, in the absence of the magnetic field, the material transforms between the first allotrope phase and the second allotrope phase, and (ii) determining a shifted allotropic phase transformation temperature where, in the presence of the magnetic field, the material transforms between the first allotrope phase and the second allotrope phase, and (iii) maintaining a temperature of the material in the mold between the nominal allotropic phase transformation temperature and the shifted allotropic phase transformation temperature while applying pressure and the magnetic field to the material.

20. The method of claim 19, wherein maintaining a temperature of the material comprises heating the material to a target temperature using induction heating.

21. The method of claim 19, wherein the shifted allotropic phase transformation temperature is less than the nominal allotropic phase transformation temperature by at least 25 degrees Fahrenheit.

22. The method of claim 18, wherein the cavity comprises a near-net-shape cavity defining a shape of a final product.

23. The method of claim 18, further comprising, responsive to stopping the magnetic cycling of the magnetic field, removing a densified part from the mold.

24. The method of claim 18, wherein the first strength of magnetic field comprises an off state of the magnetic field and the second strength of magnetic field comprises an on state of the magnetic field.

25. The method of claim 18, wherein the second strength of magnetic field is greater than 0.2 Tesla.

26. The method of claim 18, further comprising exposing the material to a vacuum environment.

27. The method of claim 18, wherein the magnetic field applied to the material is directed or intensified by a field concentrator.

28. The method of claim 18, further comprising, responsive to determination that the ram assembly has ceased movement during magnetic cycling of the magnetic field, adjusting a temperature of the material to cause the material to undergo annealing.

29. The method of claim 18, wherein the material comprises a powdered ceramic or a powdered metal alloy.

30. The method of claim 18, wherein the material comprises Ti-6Al-4V.

31. The method of claim 1, further comprising, responsive to the threshold number of iterations of magnetic cycling of the magnetic field occurring, adjusting a temperature of the material to cause the material to undergo annealing.

32. The method of claim 1, wherein applying pressure to the material in the mold comprises applying uniaxial pressure via a ram assembly.

* * * * *